US009456483B2

(12) United States Patent
Soles et al.

(10) Patent No.: US 9,456,483 B2
(45) Date of Patent: Sep. 27, 2016

(54) FIELD PROGRAMMABLE MULTI-EMITTER

(71) Applicants: Alexander Soles, Bloomington, IN (US); Joel McWhinney, Raeford, NC (US)

(72) Inventors: Alexander Soles, Bloomington, IN (US); Joel McWhinney, Raeford, NC (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 573 days.

(21) Appl. No.: 14/087,691

(22) Filed: Nov. 22, 2013

(65) Prior Publication Data

US 2016/0227620 A1 Aug. 4, 2016

Related U.S. Application Data

(63) Continuation of application No. 14/054,478, filed on Oct. 15, 2013, now abandoned.

(60) Provisional application No. 61/713,679, filed on Oct. 15, 2012.

(51) Int. Cl.
*H05B 37/02* (2006.01)
*H05B 33/08* (2006.01)

(52) U.S. Cl.
CPC ..... *H05B 33/0863* (2013.01); *H05B 33/0845* (2013.01)

(58) Field of Classification Search
CPC ..... G06K 7/10; H05B 33/0863; H05B 33/0845; H05B 37/02
USPC ..... 315/129, 131, 132, 185 R, 186, 194, 315/246, 247; 362/205, 611–612, 632; 235/435, 454, 455, 456
See application file for complete search history.

(56) References Cited

U.S. PATENT DOCUMENTS

2007/0040035 A1* 2/2007 Kotlarsky ..... G06K 7/10683 235/462.45

* cited by examiner

*Primary Examiner* — Minh D A
(74) *Attorney, Agent, or Firm* — Christopher A. Monsey

(57) ABSTRACT

A compact multi-emitter source that can be used for a multitude of purposes including identification of friend or foe, landing zones, roadways, obstructions, aircraft, vehicles, personnel, and underwater marking and can be quickly programmed in field conditions and requires no additional support items to operate.

4 Claims, 4 Drawing Sheets

FIELD PROGRAMMABLE MULTI-EMITTER

CROSS-REFERENCE TO RELATED APPLICATIONS

The present application claims priority to U.S. patent application Ser. No. 14/054,478, filed Oct. 15, 2013, entitled "FIELD PROGRAMMABLE MULTI-LIGHT, which claims priority to U.S. Provisional Patent Application Ser. No. 61/713,679, filed Oct. 15, 2012, entitled "FIELD PROGRAMMABLE MULTI-LIGHT," the disclosures of which are expressly incorporated by reference herein.

STATEMENT REGARDING FEDERALLY SPONSORED RESEARCH OR DEVELOPMENT

The invention described herein was made in the performance of official duties by employees of the Department of the Navy and may be manufactured, used and licensed by or for the United States Government for any governmental purpose without payment of any royalties thereon.

BACKGROUND AND SUMMARY OF THE DISCLOSURE

The present invention relates to a multiple multi-wavelength electromagnetic spectrum source that is lightweight, can be quickly programmed in field conditions, and requires no additional support items to operate. Devices that currently exist are not intuitive to operate, lack key functionality, cannot be programmed or alter function absent special tools/implements which can easily be lost/difficult to keep track of, are bulky, not adapted for ease of use by a user, have non-standard/difficult to obtain power sources, and typically are adapted to a specific operation for a specific purpose. Accordingly, a need exists for programmable signaling devices that enable a variety of emitters while maintaining a standard, easily obtained power source.

An embodiment of the invention can provide an intuitive field programmable multi-light that can be used for a multitude of purposes including identification of friend or foe (IFF), illumination of landing zones, roadways, obstructions, aircraft, vehicles, personnel, and underwater marking. Other wavelengths in the visible spectrum may be used to communicate between teams during rescue missions, game hunters, trackers, law enforcement, security forces, military units, emergency personnel, as well as use with remotely piloted systems that are very small or to just simply find your way along terrain at night. An exemplary device offers multiple light sources. White light is best for general purpose lighting situations where covertness is not important. Blue light sources may be used by hunters to track blood due to its high contrast with the surrounding environment. Red light is best for preserving the human eye's ability to see at night due to their minimal impact on the rod cells in the eye. When using infrared emitters, this illumination device can be seen at long ranges by existing technology such as night vision equipment that cannot be seen by the naked eye. Using night vision equipment, it can also be seen through clothing. For personnel carried devices, multiple electromagnetic sources, e.g., light sources, are needed to carry out specific tasks in a wide range of applications and missions.

According to one illustrative embodiment of the present disclosure, a field-programmable multi-light includes a housing that encapsulates a printed circuit board. Three light-emitting diode (LED) light sources are attached to the circuit board and are operably coupled to the emitter driver system. Other components attached to the circuit board include a microcontroller received within the housing and operably coupled to the driver system. A battery is operably coupled to the driver system and the power management system. The power management system includes a signal generator coupled to the battery and configured to generate first and second voltage signals. The power management system can utilize all available energy that a standard nine volt battery has to offer while delivering highly efficient power to the load devices. This efficiency adds up to a longer battery life and greater device performance gains without compromising circuit board real-estate. Small battery systems, e.g., nine volt powered illumination devices, do not carry a power switch such as in this invention. By implementing a power switch that is adapted to function in rough wear conditions and small applications, wear and tear on battery contacts is reduced as a user does not have to plug and unplug the battery to use the device.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

Figure 1:
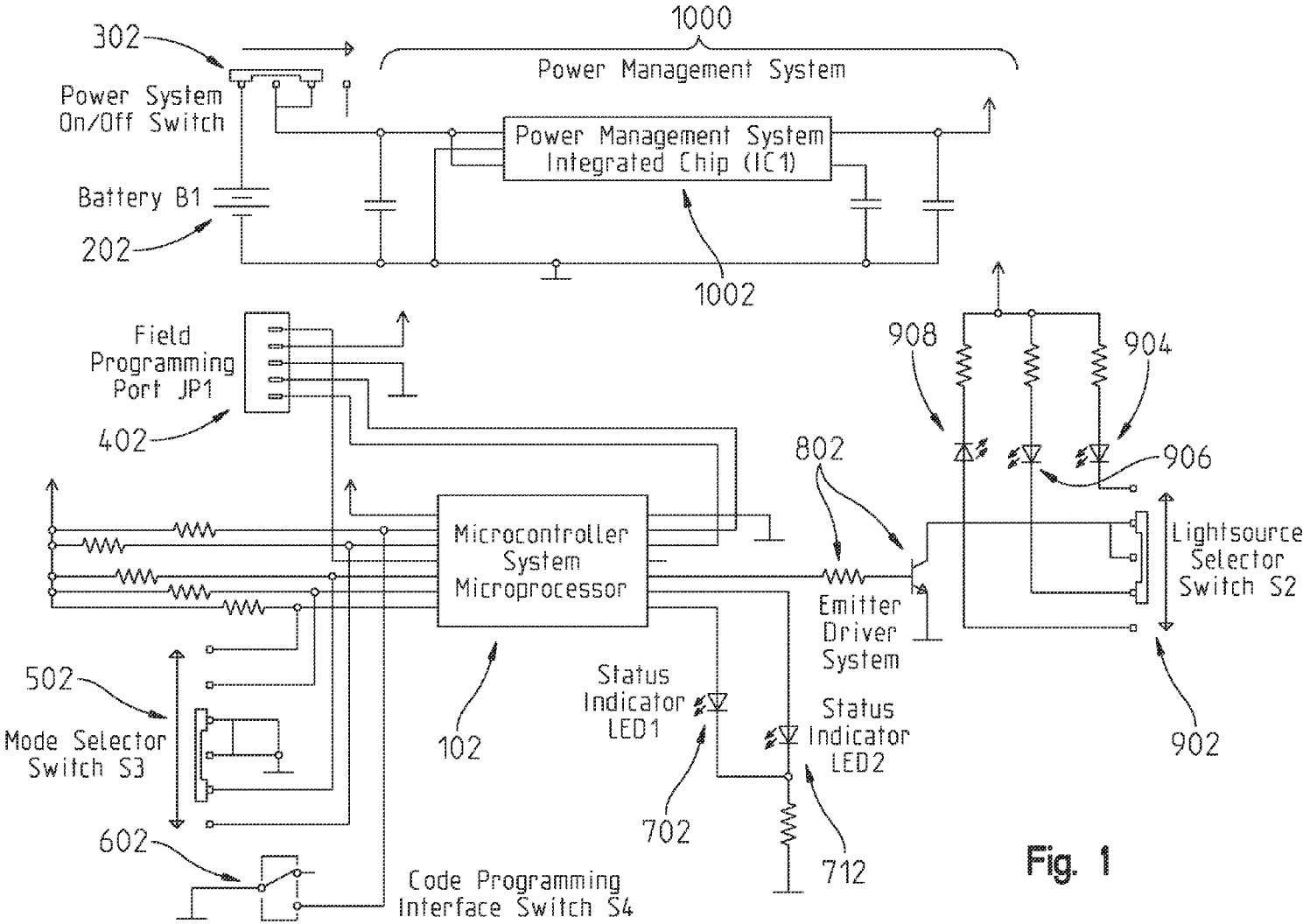
FIG. 1 is a schematic view of an illustrative field programmable multi-light system in accordance with one embodiment of the invention.

For the purposes of promoting an understanding of the principles of the invention, reference will now be made to the embodiments illustrated in the drawings, which are described below. The embodiments of the invention described herein are not intended to be exhaustive or to limit the invention to precise forms disclosed. Rather, the embodiments selected for description have been chosen to enable one skilled in the art to practice the invention.

Referring to FIG. 1, an illustrative field programmable multi-spectrum e.g., light device of an exemplary embodiment of the invention. A microcontroller processor (MPC) 102 controls operations of the device and illustratively includes a plurality of electrical terminals or ports to connect other components of the system. An exemplary MPC 102 can be programmed with machine readable instructions adapted to, for example, control peripherals attached and controlled by the MPC 102 to execute operations, such as described in this disclosure. A Mode Selector Switch (MSS) 502 and two status indicator light emitting diodes (LED) 702 and 712 are coupled to the MPC 102. A Field Programming Port (FPP) 402 provides for communication between the MPC 102 and an external computer to, e.g., change system operating characteristics when a user is in an operating environment such as a field context. A Code Programming Interface Switch (CPIS) 602 can be a spring loaded switch, which allows a user to operate the CPIS 602 during program mode to input machine readable instructions to operate the multi-light without a need to utilize additional programming tools or items such as a metal implement or tool. The exemplary CPIS 602 can be used in the field to manually program or enter light sequences for signaling and other forms of communication which operate various elements of the multi-light system e.g., LEDs via e.g. MPC 102 and programmed code sequences or programmed logic. An on/off power switch 302 can be used to turn the device on and off and can be coupled to a battery 202.

A mode selector switch 502 can be coupled to the microcontroller processor 102 which can be used to select one of, e.g., four modes of operation which a user selects via the MSS 502: mode 1) solid "on"—operates like a flashlight; mode 2) pulse—outputs a unique eye-catching rapid strobe flash; mode 3) S.O.S.—outputs a survival Morse code S.O.S. signal; mode 4) user program mode—allows the operator to program in any flash signal or Morse code signal with the help of the CPIS 602. Red and green feedback LEDs, 712 and 702 respectively, can assist an operator during programming. User program mode can store an amount of CIPS inputs e.g., up to 20 seconds of button presses into memory, which can be stored as programmed light sequences that can be used to, e.g., drive the LEDs. A light source selector also can allow a user to select between various emitters e.g., light sources, including high intensity light sources in the Infrared, red, and white spectrums.

With further reference to FIG. 1, an Emitter Driver System (EDS) 802 is coupled to the exemplary MCP 102 and a Light Source Selector Switch (LSSS) 902, which can be used to select one of several LED light sources including infrared (IR) 908, red 906, or white 904. In another illustrative embodiment, other emitters, e.g., electromagnetic spectrum sources (e.g., ultraviolet) may be used to customize the device. A battery 202 can be coupled to a Power Management System (PMS) 1000 and a PMS Integrated Chip (PMSIC) 1002.

Figure 2:
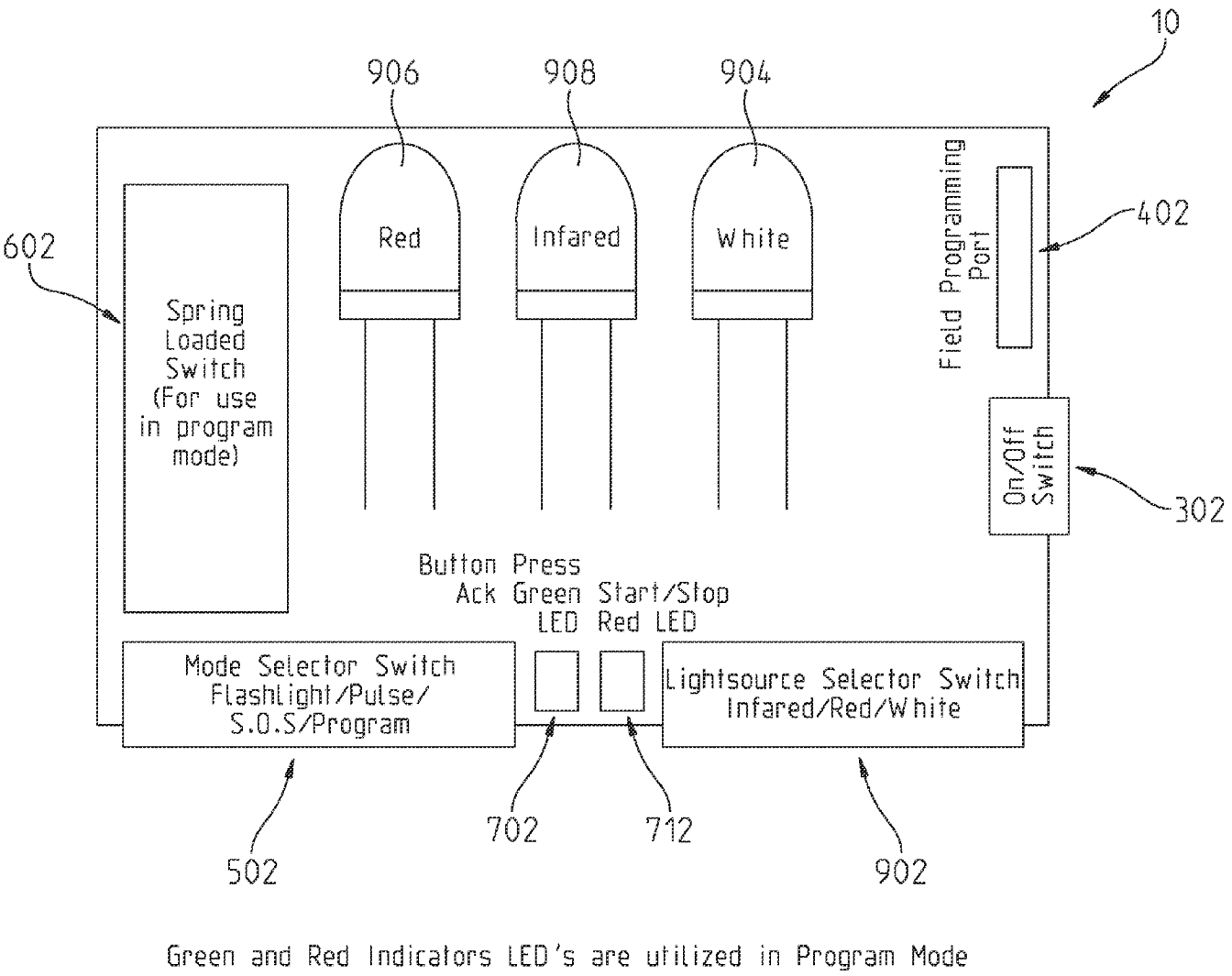
FIG. 2 is a simplified diagram of an operating system of an illustrative field programmable multi-light in accordance with one embodiment of the invention such as described in FIG. 1.

Referring to FIG. 2, a simplified diagram of an exemplary field programmable multi-light 10 is shown comprising three light sources, red 906, IR 908, and white 904, an on/off power switch 302, a FPP 402, a MSS 502, a CPIS 602 for manually entering stored light sequences, a press acknowledgement green LED 702, and a start/stop red LED 712. Green LED 702 acknowledges a button CPIS 602 press/activation and red LED 712 acknowledges a beginning and/or end of a code programming sequence input using the CPIS 602. The field programmable multi-light 10, including housing and operating system, can have a total footprint of 1.26 inches in length and 0.871 inches in width.

In the illustrative embodiment, a FPP 402 allows a user to interface with the onboard MPC 102. A small block of Electronically Erasable Programmable Read-Only Memory (EEPROM) (e.g., 265 bits) onboard the exemplary MPC 102 stores and recalls operator inputs for up to twenty seconds from the CPIS 602 at a top of the exemplary device. When a user program mode is selected, the exemplary device waits for input. When the operator presses the CPIS 602, red LED 712 located at the back of the device momentarily lights up to signify a start of a program mode. The operator can then tap the CPIS 602 to "code in" a unique sequence of long and short button presses (e.g. Morse code "dits" and "dahs") for up to, e.g., 20 seconds. As the operator "codes in", a green confirmation LED 702 lights up to provide visual feedback for the duration of the button presses. After the exemplary twenty seconds has lapsed, the red LED 712 momentarily flashes to signify an end of the program mode. The exemplary device 10 then replays the programmed light sequence continuously until, for example, either one of the two events happen by an operator's selection: power removal or a mode select change. At any time while the programmed light sequence is continuously playing back, the operator can select between the exemplary three available light sources to output a desired message.

An exemplary circuit board has battery terminals attached to one side which directly couple to the battery's terminals. An ultra-efficient onboard battery voltage converter allows the device to run longer than traditional devices, thus increasing mission lifespan. An exemplary device can also host an ability to be reprogrammed with encoded message signals, custom flash rates, and etc. While an exemplary multi-light is powered on and in pulse mode, an exemplary circuit uses approximately 5 mA of continuous power at a 10% duty cycle. Meaning that the exemplary emitters are only on ten percent of operating time. Note that a duty cycle also is dependent on internal programming. This continuous power drain equates to approximately 120 hours of continuous use in optimal conditions. A user can remove or replace a battery by use of the battery plug contacts when an exemplary battery has been exhausted or the device is stored for long periods of time.

Figure 3:
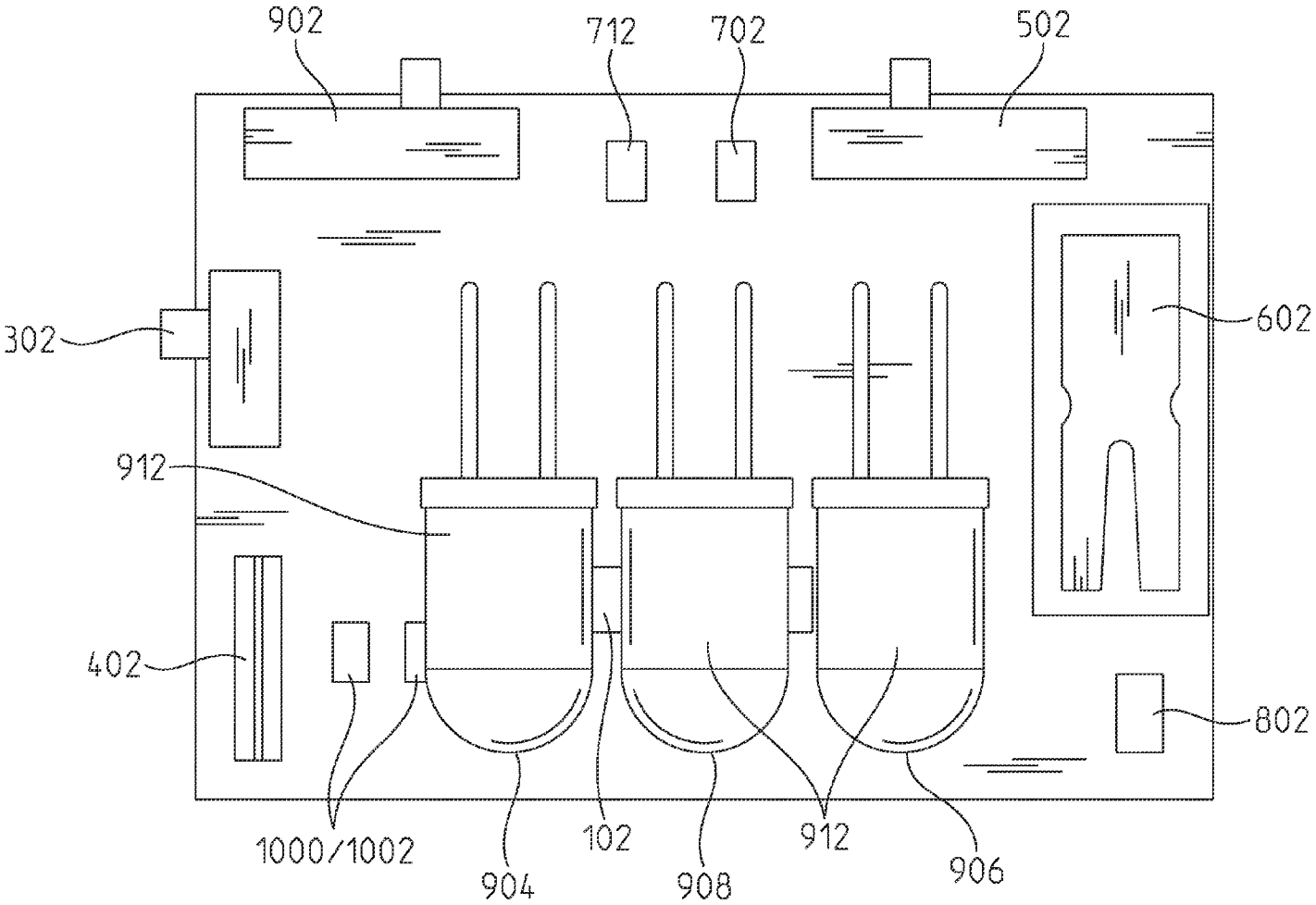
FIG. 3 shows a top view of an exemplary embodiment of the invention as described in FIGS. 2 and 3 with an addition of a reflector coating on a portion of multi-light emitters.
Figure 4:
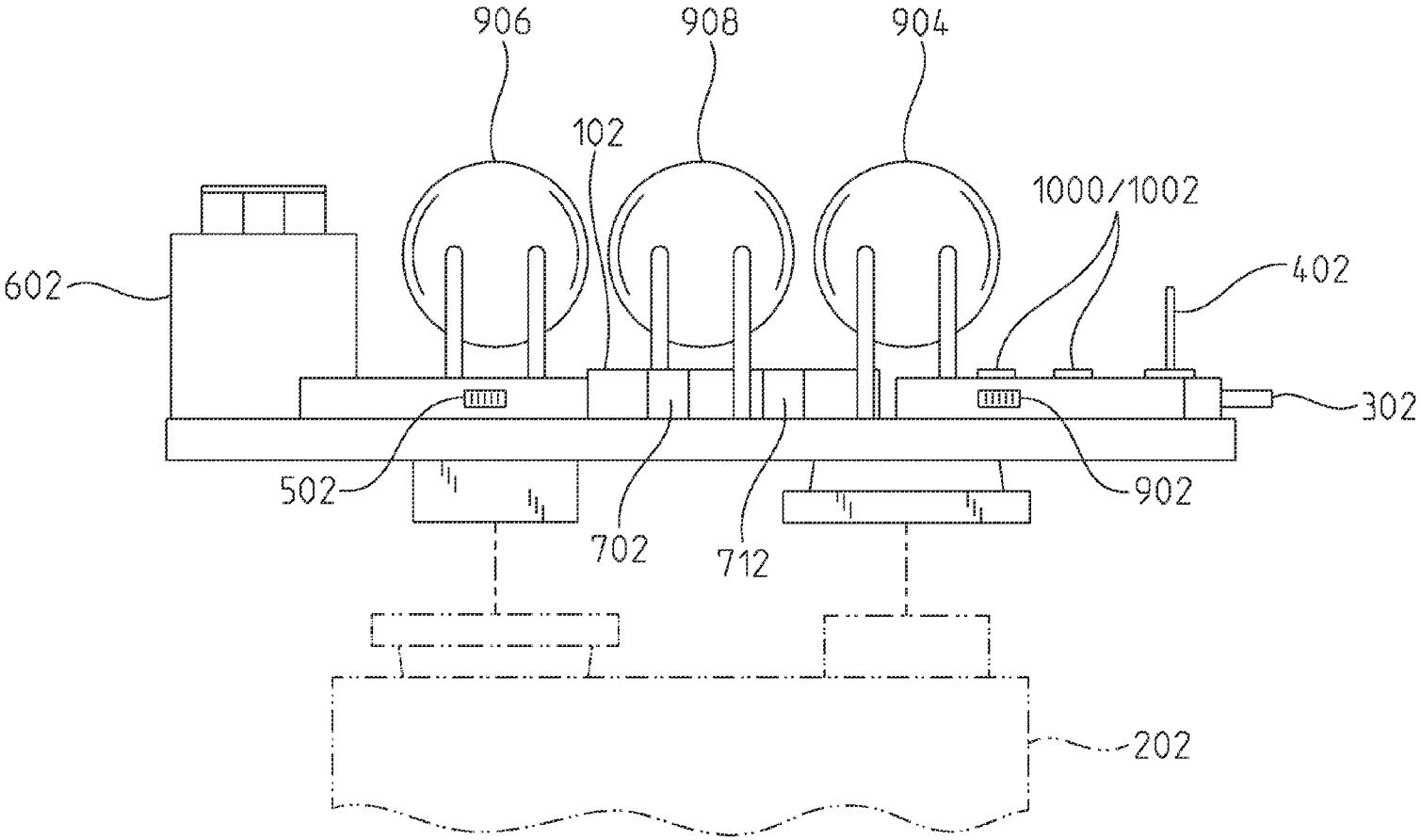
FIG. 4 shows a rear side view of an exemplary embodiment of the invention as described in FIGS. 2, 3, and 4.

FIGS. 3 and 4 shows a depiction of the FIGS. 1 and 2 exemplary embodiment(s) with an addition of reflector coatings or structures 912 made with, e.g., aluminum flashing tape and non-conductive silver paint which can be used to reduce LED source 904, 906, 908 light back-feed/backscatter in an opposite direction from a desired orientation of LED 904, 906, 908 emission and increase optical performance.

A PMS can include an ultra-efficient onboard battery voltage converter which allows the device to run longer than traditional devices. An exemplary system can also have a FPP that allows custom code (e.g., encoded message signals, custom flash rates, etc.) to be uploaded to the device from another device. This embodiment of the invention can be reprogrammed via an on-board connection header, e.g., FPP, with multiple mode control with various flash rates and codes. This embodiment could also be programmed and setup to be used to display IFF information. A field programming switch features an easy to use CPIS 602 so there are no additional items required to operate.

An embodiment of a multi-light invention can include light sources including white, IR, red, and blue. A feature of an exemplary multi-light is that a light source can be switched without interrupting operation of the selected mode. An embodiment can include sources such as high intensity LED emitter diodes. White light can be best for general purpose lighting situations where covertness is not important. Blue light sources may be used by hunters to track blood due to its high contrast with the surrounding environment. Red light is best for preserving the human eye's ability to see at night due to their minimal impact on the rod cells in the eye. When using IR emitters, this illumination device can be seen by existing technology such as night vision equipment and cannot be seen by the naked eye. Using night vision equipment, it can also be seen through clothing. These sources can be switched out to fit the customer's exact need.

An embodiment of the invention can also include customizable emitter diodes. An embodiment of a multi-light invention can be outfitted with an emitter diode light source that's wavelength and operation is customizable by the customer. A light source's power output, visibility, and range can be matched to specific requirements. The customizable light source can be in the ultraviolet, visible, and infrared (near, short, mid, and long wavelengths) depending on the desired application. This is a significant advantage since sensors operated in these wavelength ranges can render this device completely invisible to an observer or sensor system which can reduce or eliminate interference or undesirable effects. Embodiments of the invention can include fiber optic (glass, poly-plastics) light tubes to redirect light energy from a surface mount or through-hole (or radial lead) LEDs. By this method, light sources can be placed anywhere on the circuit board and redirected in any direction.

An embodiment of the invention can include waterproofing design aspects so the system can withstand submersion of more than 60 meters depth in water. This involves redesigning the device so the switches, battery plug, and housing are air-tight. A case made of aluminum, poly-plastics, rubbers can be used.

Although the invention has been described in detail with reference to certain preferred embodiments, variations and modifications exist within the spirit and scope of the invention as described and defined in the following claims:

The invention claimed is:

1. A programmable multi-emitter comprising:

a housing;

a plurality of electromagnetic emitter sources, a microprocessor controller, and a memory coupled to said housing;

a first plurality of machine interpretable processing instructions stored in said memory adapted to be read by said microprocessor controller and thereby control the programmable multi-emitter system including said plurality of electromagnetic emitter sources;

a plurality of interfaces coupled to at least said microprocessor comprising a first interface, a second interface, a third interface, a fourth interface, and a fifth interface;

wherein said first interface comprises a user manually manipulatable on/off switch adapted to apply power to said multi-light, said second interface comprises an emitter source selector adapted to select one or more of said plurality of electromagnetic emitters for operation, said third interface is adapted to enable a mode control selection comprising a selection of one of a plurality of operating modes associated with some of the first plurality of machine interpretable processing instructions which execute predetermined operations of said plurality of electromagnetic emitter sources having a predetermined functionality operated by said microprocessor controller;

wherein said plurality of operating modes comprise a first, second, third, and fourth mode processing adapted for controlling operation of said plurality of light sources, said first mode comprising a user programmable input mode, said second mode comprises a continuous-on mode, said third mode comprises a pulse mode, and said fourth mode comprises an emergency emitter mode;

wherein said fourth interface is a code programmable interface switch adapted to manually program, enter, or modify at least some of said first plurality of machine interpretable processing instructions adapted for controlling said multi-light to emit electromagnetic spectrum sequences for signaling or other forms of communication which operate various elements of the multi-light system;

a power source operably coupled to at least some of said multi-light components comprising the microprocessor controller and said plurality of electromagnetic spectrum emitters; and a power management system operably coupled to the battery adapted to control and reduce or optimize power delivered or consumed by the multi-light system;

wherein said plurality of electromagnetic emitters are formed to have a first emission axis region and an emission blocking region, said emission blocking region is formed with an emission blocking and reflection section adapted to reflect and orient emissions from said plurality of electromagnetic emitters away from said emission blocking region.

2. The programmable multi-emitter of claim 1, further comprising status indicator lights operably coupled to the controller processor and configured to display a visible red, start/stop light adapted to indicate when inputs from said code programmable interface switch is enabled for recording as a second plurality of machine interpretable processing instructions generated from the user's operation of said code programmable interface switch into said memory and a visible green, acknowledgement light adapted to indicate that said code programmable interface switch is being operated by a user.

3. The Programmable multi-emitter of claim 2, further comprising a fifth interface comprising a input/output structure adapted to enable communication between the processor controller and an external computer to receive and store a second plurality of machine interpretable processing instructions that modify or add to at least some of said second plurality of machine interpretable processing instructions adapted to change system operating characteristics.

4. The Programmable multi-emitter of claim 1 further comprising a clamping structure adapted to couple said battery to a power bus of said multi-light.

* * * * *